United States Patent [19]

McClaflin

[11] 4,274,943

[45] Jun. 23, 1981

[54] REMOVAL OF METAL ALKARYL SULFONATES FROM HYDROCARBONS

[75] Inventor: Gifford G. McClaflin, Ponca City, Okla.

[73] Assignee: Conoco, Inc., Ponca City, Okla.

[21] Appl. No.: 76,655

[22] Filed: Sep. 18, 1979

[51] Int. Cl.[3] ..... C10M 11/00

[52] U.S. Cl. ..... 208/181; 585/854; 208/251 R; 208/253

[58] Field of Search ..... 208/251 R, 181, 253; 585/856, 854

[56] References Cited

U.S. PATENT DOCUMENTS

| | | | |
|---|---|---|---|
| 4,105,542 | 8/1978 | Fainman | 208/181 |
| 4,151,072 | 4/1979 | Nowack et al. | 208/251 R |

FOREIGN PATENT DOCUMENTS

| | | | |
|---|---|---|---|
| 50-46705 | 4/1975 | Japan | 208/181 |
| 50-22980 | 8/1975 | Japan | 208/181 |

*Primary Examiner*—Delbert E. Gantz
*Assistant Examiner*—Joseph A. Boska
*Attorney, Agent, or Firm*—Bayless E. Rutherford, Jr.

[57] ABSTRACT

A method of removing metal alkaryl sulfonates from a hydrocarbon solution is disclosed. Briefly, the method comprises (a) contacting the hydrocarbon solution containing metal alkaryl sulfonates with an aqueous basic solution containing a "recovery" surfactant, (b) forming a hydrocarbon phase and an aqueous phase containing metal alkaryl sulfonates and (c) separating the hydrocarbon phase and the aqueous phase.

8 Claims, No Drawings

REMOVAL OF METAL ALKARYL SULFONATES FROM HYDROCARBONS

DISCLOSURE

1. Field of the Invention

The invention is in the field of removing metal alkaryl sulfonates from a hydrocarbon solution (e.g. a crude oil).

2. General Background

Aqueous solutions containing metal alkaryl sulfonates are used in the recovery of petroleum (e.g. crude oil) from subterranean formations. After separation of the aqueous solution and the crude oil often a substantial amount (e.g. 100–1000 parts per million) remains in the crude oil. The metal alkaryl sulfonate must be removed from the crude oil before the crude oil is refined since the presence thereof causes many problems in the refinery, e.g. corrosion and water problems.

I have discovered an effective way of removing metal alkaryl sulfonates from crude oil and other hydrocarbons.

BRIEF SUMMARY OF THE INVENTION

Briefly stated, the present invention is directed to a method of removing metal alkaryl sulfonates from a hydrocarbon solution, wherein said method comprises:

(a) contacting the hydrocarbon solution containing a metal alkaryl sulfonate with an aqueous basic solution containing an effective amount of a "recovery" surfactant, (b) forming a hydrocarbon phase and an aqueous phase containing methyl alkaryl sulfonate, and (c) separating the hydrocarbon phase and the aqueous phase.

The recovery surfactant is described in the detailed description.

In one aspect, step (a) of the present invention can be conducted by adding to the hydrocarbon solution containing metal alkaryl sulfonate, water, basic compound, and recovery surfactant in any order.

DETAILED DESCRIPTION

My method is suitable for removing from hydrocarbons metal alkaryl sulfonates represented by the following formula

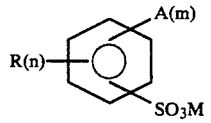

wherein

A = hydrogen or a $C_1$–$C_4$ alkyl group m = 1 or 2 when A is alkyl

R = $C_9$–$C_{18}$ alkyl group n = 1 or 2

M = alkali metal, preferably sodium when A is hydrogen, m = 1 when A is alkyl the maximum number of carbon atoms in A(m) is 4, and the total number of carbon atoms in A(m) and R is in the range of 12 to 22, preferably 12 to 18.

The preferred sulfonate is a sodium mono- or dialkyl benzene sulfonate wherein the alkyl group contains from 9 to 18 carbon atoms. The most preferred sulfonate is a sodium monoalkylbenzene sulfonate wherein the alkyl group contains 12 to 18 carbon atoms.

The metal alkaryl sulfonate is usually present in a crude oil. However, my process is applicable to liquid hydrocarbons, either pure or mixtures thereof, containing from 6 to 18 carbon atoms. The hydrocarbons can be straight-chain or branched-chain. In order to be liquid it is necessary that the hydrocarbon containing higher carbon atoms (e.g. above $C_{12}$) contain branched-chain materials. With mixtures of hydrocarbons containing higher carbon atoms it is necessary that a larger amount of branched-chain hydrocarbons be present.

Preferably, my process uses an aqueous solution which is (a) basic and (b) contains an effective amount of a "recovery" surfactant. The term basic refers to an aqueous solution having a pH in the range of 7.1 to 14, preferably 9 to 12. In order that the aqueous solution have the required pH usually it is necessary to add a small amount of basic material to the solution. Example of suitable basic material include alkali metal hydroxides and carbonates. Sodium hydroxide is particularly suitable. Knowing that the aqueous solution should have a pH of 7.1 to 14 any person skilled in the art can readily add the required amount.

As indicated previously, my process can be conducted by adding the water, basic compound and recovery surfactant separately to the hydrocarbon solution containing metal alkaryl sulfonate.

The amount of water used, based on the amount of hydrocarbon, suitably is in the range of 0.5:1 to 10:1, preferably 1:1 to 5:1 on a weight basis.

The term "recovery" surfactant is used to describe the material which is used in the aqueous solution in combination with the required amount of basic material. Examples of suitable types of "recovery" surfactants include the following:

(a) ethoxylated alcohols (b) ethoxylated alkylphenols (c) ethoxylated alcohol sulfates (d) polyoxyethylene-polyoxypropylene block polymers, and (e) ethoxylated polypropylene glycols.

The ethoxylated alcohols which are used in my invention are represented by one of the following formulae $$RO(CH_2CH_2O)_nH \qquad (A)$$

wherein R is an alkyl group containing from 10 to 20, preferably 12 to 18, carbon atoms and n is a number in the range of about 5 to about 40, preferably about 10 to about 25. Linear alkyl groups are particularly suitable. While more than 40 moles of ethylene oxide may possibly be used, materials containing this amount are not particularly better and are not readily available.

$$R-(O\overset{\overset{CH_3}{|}}{C}HCH_2)_m(CH_2CH_2O)_nOH \qquad (B)$$

wherein R is an alkyl group, preferably linear, containing 10 to 20, preferably 12 to 18, carbon atoms, m is a number in the range of 1 to 32, preferably 6 to 30, and n is a number in the range of 2 to 30, preferably 4 to 20.

Suitable ethoxylated alkyl phenols are mono- or dialkyls, wherein each alkyl group contains from about 8 to 12 carbon atoms, and which contain from about 20 to about 100 ethoxy groups, preferably from about 30 to about 70 ethoxy groups. The preferred ethoxylated alkyl phenol is a monoalkylphenol containing 8 to 10 carbon atoms in the alkyl group.

Suitable ethoxylated alcohol sulfates are represented by the following structural formula $$[CH_3(CH_2)_xCH_2(OCH_2CH_2)_nOSO_3]M$$

wherein x is an integer in the range of about 8 to about 20, preferably from about 10 to about 16, n is a number in the range of about 1 to about 50, preferably about 2 to about 30, more preferably about 3 to about 12, and M is $NH_4$ or Na, but preferably is sodium.

The alcohol moiety of the ethoxylated alcohol sulfate can be an even or odd number or a mixture thereof. Preferably, the alcohol moiety is an even number. Also, preferably, the alcohol moiety contains 12 to 18 carbon atoms.

Polyoxyethylene-polyoxypropylene block polymers which are used in my invention are represented by one of the following formulae:

$$HO(CH_2CH_2O)_a\,(\overset{\overset{\displaystyle CH_3}{|}}{C}HCH_2O)_b\,(CH_2CH_2O)_cH$$

wherein a and c are numbers in the range of 1 to 15, preferably in the range of 2 to 10, with the sum of a and c being in the range of 2 to 30, preferably 4 to 20, and b is a number in the range of 1 to 32, preferably 6 to 30 or $$HO(\overset{\overset{\displaystyle CH_3}{|}}{C}HCH_2O)_a\,(CH_2CH_2O)_b\,(\overset{\overset{\displaystyle CH_3}{|}}{C}HCH_2O)_cH$$

wherein a and c are numbers in the range of 1 to 16, preferably 3 to about 15, with the sum of a and c being in the range of 2 to 32, preferably 6 to 30, and b is a number in the range of 2 to 30, preferably 4 to 20.

Suitable ethoxylated polypropylene glycols are those containing from about 10 to about 60 weight percent ethylene oxide and having a molecular weight in the range of about 1300 to about 2900. The preferred ethoxylated polypropylene glycols are those containing from about 20 to about 50 weight percent ethylene oxide and having a molecular weight in the range of about 1500 to about 2500.

The amount of recovery surfactant in the aqueous solution suitably is in the range of about 10 to about 10,000 parts per million by weight based on the hydrocarbon. On the same basis the preferred amount of recovery surfactant is in the range of about 50 to about 500 parts per million by weight.

In conducting my process as admixture is formed of the hydrocarbon and the basic aqueous solution containing the recovery surfactant. (As indicated hereinbefore the water, basic compound and recovery surfactant can be added separately.) The admixture preferably is heated to a temperature in the range of about 100° F. to about 200° F. The admixture is agitated sufficiently to allow contact between the hydrocarbon and aqueous solution. The admixture is then allowed to stratify, forming an aqueous layer and a hydrocarbon layer. The layers are then separated. The aqueous layer contains basic material, recovery surfactant and a part of the metal alkaryl sulfonate.

My process usually provides better than a 40 weight percent recovery of the sulfonate from the hydrocarbon. It is readily apparent that using a multi-stage adaptation of my process could result in recovering substantially all of the sulfonate present in the hydrocarbon. For example, assuming a 50 percent recovery, a five-stage process would recover better than 96 percent of the sulfonate.

In order to illustrate the nature of the present invention still more clearly the following examples will be given. It is to be understood, however, that the invention is not to be limited to the specific conditions or details set forth in these examples except insofar as such limitations are specified in the appended claims.

EXAMPLES 1-5

These examples are both illustrative and comparative.

Materials Used

Sulfonate—a sodium monoalkylbenzene sulfonate having an equivalent weight of 334 (52 weight percent active ingredient)

Hydrocarbon—Goodwin crude oil from Cat Canyon Field, Santa Maria, California

Water—Synthetic "hard" water containing 5000 ppm total hardness

Sodium Hydroxide—reagent grade

Recovery Surfactants

"A"—sodium salt of a sulfated ethoxylate derived from a $C_{12}$-$C_{18}$ linear primary alcohol blend and containing 9.25 moles of ethylene oxide (20 percent active ingredient)

"B"—an ethoxylated octylphenol containing 30 moles of ethylene oxide per mole of octylphenol (70 percent active ingredient)

"C"—an ethoxylated octylphenol containing 70 moles of ethylene oxide per mole of octylphenol (100 percent active ingredient)

Five solutions were prepared containing the following materials.

| | | |
|---|---|---|
| Example 1 | sodium monoalkylbenzene sulfonate | 0.114 g |
| | water added to 300 grams | |
| Example 2 | sodium monoalkylbenzene sulfonate | 0.057 g |
| | recovery surfactant "C" | 0.03 g |
| | water added to 300 grams | |
| Example 3 | sodium monoalkylbenzene sulfonate | 0.057 g |
| | recovery surfactant "B" | 0.02 g |
| | recovery surfactant "C" | 0.015 g |
| | water added to 300 grams | |
| Example 4 | sodium monoalkylbenzene sulfonate | 0.057 g |
| | recovery surfactant "C" | 0.03 g |
| | sodium hydroxide (10 percent active solution) | 1.2 g |
| | water added to 300 grams | |
| Example 5 | Sodium monoalkylbenzene sulfonate | 0.057 g |
| | Recovery surfactant "A" | 0.136 g |
| | Sodium Hydroxide added to 300 grams | |

Procedure

The solutions of each of the examples were divided into two portions. One portion was saved for sulfonate analysis and the other portion was contacted with an equal weight of the Goodwin crude oil at 170° F. The admixture of the solution and crude oil were shaken in a sealed container after which they were transferred to centrifuge tubes where they were allowed to cool at room temperature. Then they were centrifuged at about 2200 rpm for one half hour. This produced an oil layer and a water layer. The water portion was removed and weighed.

The original solution for each example and the recovered water solution from the crude oil/water emulsions were analyzed for sulfonate content using the standard Methylene Blue Test. The results of the tests are summarized in Table I.

TABLE I

| Example No. | Sulfonate Analysis of Solution of Examples (ppm) | Composition of Emulsion | Sulfonate Analysis on Water Recovered from Emulsion (ppm) | Sulfonate Recovered (%) |
|---|---|---|---|---|
| 1 | 210 | Solution of Example 1 (50 g) Crude Oil (50 g) | 61 | 22.1 |
| 2 | 111 | Solution of Example 2 (50 g) Crude Oil (50 g) | 0 | 0 |
| 3 | 115 | Solution of Example 3 (50 g) Crude Oil (50 g) | 0 | 0 |
| 4 | 111 | Solution of Example 4 (50 g) Crude Oil (50 g) | 61 | 55 |
| 5 | 160 | Solution of Example 5 (50 g) Crude Oil (50 g) | 92 | 58 |

EXAMPLES 6 AND 7

These examples are both illustrative and comparative concerning my invention.

The materials used were the same as in Examples 1–5, except the monoalkylbenzene sulfonate was 27 percent active.

Two solutions were prepared comprising 50 grams of Goodwin lease crude and 0.019 gram of a 27 percent monoalkylbenzene sulfonate (net amount of sulfonate=5.13 mg.)

A solution was prepared comprising 50 g of synthetic water and 5 mg of recovery surfactant "C".

A second solution was prepared comprising 50 g of synthetic water, 5 mg of recovery surfactant "C" and 20 mg of sodium hydroxide.

EXAMPLE 6

The following were added to a reaction vessel:

(a) solution containing crude plus monoalkylbenzene sulfonate, and (b) solution containing water plus recovery surfactant "C".

The admixture was heated to 170°-200° F. (this is because the crude was quite viscous). It was then agitated by shaking. After allowing the resulting emulsion to cool it was centrifuged at 2,000 rpm for 45 minutes. An oil phase and a water phase were formed. The water phase was 42 grams which contained 40 ppm of sulfonate (methylene blue titration). Thus there was recovered 1.68 mg of sulfonate or about 33 percent of the original amount.

EXAMPLE 7

The following were added to a reaction vessel:

(a) solution containing crude plus monoalkylbenzene solfonate, and (b) solution containing water plus recovery surfactant "C" plus sodium hydroxide.

The procedure used was the same as in Example 6. The recovered water phase amounted to 42 grams which contained 50 ppm of sulfonate (methylene blue titration). Thus there was recovered 2.1 mg of sulfonate or about 41 percent of the original amount.

With regard to the examples, Examples 1–5 illustrate the following. The use of a combination of recovery surfactant and basic compound shift the partition coefficient of alkaryl sulfonates in a water/hydrocarbon mixture. The result is an increased amount of sulfonate in the water phase.

Examples 6 and 7 show that the use of a combination of basic compound and recovery surfactant provides an improvement in the removal of alkaryl sulfonates from a hydrocarbon.

Thus, having described the invention in detail, it will be understood by those skilled in the art that certain variations and modifications may be made without departing from the spirit and scope of the invention as defined herein and in the appended claims.

I claim:

1. A method of removing metal alkaryl sulfonate from a hydrocarbon solution containing the same, said method comprising:

(A) adding water, basic compound and recovery surfactant to a hydrocarbon solution of metal alkaryl sulfonate to form an admixture, (B) agitating the admixture, (C) allowing the admixture to form a hydrocarbon phase and an aqueous phase containing metal alkaryl sulfonate, and (D) separating the hydrocarbon phase and the aqueous phase said method being characterized further in that (a) the amount of basic compound is sufficient to provide a pH of at least 7.1, (b) the amount of water to hydrocarbon is in the range of about 0.5 to about 10:1 on a weight basis, (c) the amount of recovery surfactant is in the range of about 10 to about 10,000 parts per million by weight, based on the hydrocarbon, (d) the metal alkaryl sulfonate is represented by the formula

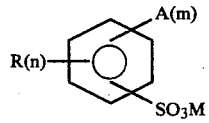

wherein

A=hydrogen or a $C_1$-$C_4$ alkyl group m=1 or 2 when A is alkyl

R=$C_9$-$C_{18}$ alkyl group n=1 or 2

M=alkali metal when A is hydrogen, m=1 when A is alkyl the maximum number of carbon atoms in A(m) is 4, and the total number of carbon atoms in A(m) and R is in the range of 12 to 22, (e) the hydrocarbon is liquid and selected from the group consisting of crude oils and $C_6$-$C_{18}$ straight and branched-chain hydrocarbons, (f) the recovery surfactant is selected from the group consisting of (i) ethoxylated alcohols represented by one of the formulae $$RO(CH_2CH_2O)_nH$$

wherein R is an alkyl group containing from 10 to 20 carbon atoms and n is a number in the range of about 5 to about 40 or $$R-(O\overset{\overset{CH_3}{|}}{C}HCH_2)_m(CH_2CH_2O)_nOH$$

wherein R is an alkyl group containing 10 to 20 carbon atoms, m is a number in the range of 1 to 32, and n is a number in the range of 2 to 30, (ii) ethoxylated alcohol sulfates represented by the formula $$[CH_3(CH_2)_xCH_2(OCH_2CH_2)_nOSO_3]M$$

wherein x is an integer in the range of about 8 to about 20, n is a number in the range of about 1 to about 50, and M is $NH_4$ or Na, (iii) polyoxyethylene-polyoxypropylene block polymers represented by one of the formulae $$HO(CH_2CH_2O)_a(\overset{\overset{CH_3}{|}}{C}HCH_2O)_b(CH_2CH_2O)_cH$$

wherein a and c are numbers in the range of 1 to 15, with the sum of a and c being in the range of 2 to 30, and b is a number in the range of 1 to 32, or $$HO(\overset{\overset{CH_3}{|}}{C}HCH_2O)_a(CH_2CH_2O)_b(\overset{\overset{CH_3}{|}}{C}HCH_2O)_cH$$

wherein a and c are numbers in the range of 1 to 16, with the sum of a and c being in the range of 2 to 32, and b is a number in the range of 2 to 30, and (g) the basic compound is selected from the group consisting of alkali metal hydroxides and alkali metal carbonates.

2. The method of claim 1 wherein the recovery surfactant is selected from the group consisting of (a) ethoxylated alcohols represented by one of the formulae $$RO(CH_2CH_2O)_nH$$

wherein R is an alkyl group containing from 12 to 18 carbon atoms and n is a number in the range of about 10 to about 25 or $$R-(O\overset{\overset{CH_3}{|}}{C}HCH_2)_m(CH_2CH_2O)_nOH$$

wherein R is an alkyl group containing 12 to 18 carbon atoms, m is a number in the range of 6 to 30, and n is a number in the range of 4 to 20, (b) ethoxylated alcohol sulfates represented by the formula $$[CH_3(CH_2)_xCH_2(OCH_2CH_2)_nOSO_3]M$$

wherein x is an integer in the range of about 10 to about 16, n is a number in the range of about 2 to about 30, and M is Na, (c) polyoxyethylene-polyoxypropylene block polymers represented by one of the formulae $$HO(CH_2CH_2O)_a(\overset{\overset{CH_3}{|}}{C}HCH_2O)_b(CH_2CH_2O)_cH$$

wherein a and c are numbers in the range of 2 to 10, with the sum of a and c being in the range of 4 to 20, and b is a number in the range of 6 to 30, or $$HO(\overset{\overset{CH_3}{|}}{C}HCH_2O)_a(CH_2CH_2O)_b(\overset{\overset{CH_3}{|}}{C}HCH_2O)_cH$$

wherein a and c are numbers in the range of 3 to 15, with the sum of a and c being in the range of 6 to 30, and b is a number in the range of 4 to 20.

3. The method of claim 2 wherein:

(a) the hydrocarbon is crude oil, (b) the metal alkaryl sulfonate is a sodium monoalkylbenzene sulfonate wherein the alkyl group contains about 12 to about 18 carbon atoms, (c) the basic compound is sodium hydroxide, (d) the recovery surfactant is a sodium salt of a sulfated ethoxylate derived from a $C_{12}$-$C_{18}$ linear primary alcohol blend and containing 9.25 moles of ethylene oxide, (e) the amount of water to crude oil is about a 1:1 weight ratio, (f) the amount of sodium hydroxide is about 400 parts per million based on the water, and (g) the amount of recovery surfactant is about 100 parts per million based on the crude oil.

4. The method of claim 2 wherein the basic compound is sodium hydroxide and the amount is sufficient to provide a pH in the admixture in the range of 7.1 to 12.0.

5. The method of claim 4 wherein the metal alkaryl sulfonate is a sodium monoalkylbenzene sulfonate wherein the alkyl group contains 12 to 18 carbon atoms.

6. The method of claim 5 wherein (a) the amount of water to hydrocarbon is in the range of about 1:1 to about 5:1 on a weight basis, and (b) the amount of recovery surfactant is in the range of about 50 to about 500 parts per million based on the hydrocarbon.

7. The method of claim 6 wherein the recovery surfactant is an ethoxylated alcohol represented by one of the formulae $$RO(CH_2CH_2O)_nH$$

wherein R is an alkyl group containing from 12 to 18 carbon atoms and n is a number in the range of about 10 to about 25 or

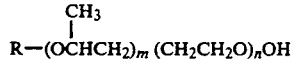

wherein R is an alkyl group containing 12 to 18 carbon atoms, m is a number in the range of 6 to 30, and n is a number in the range of 4 to 20.

8. The method of claim 6 wherein the recovery surfactant is an ethoxylated alcohol sulfate represented by the formula $$[CH_3(CH_2)_xCH_2(OCH_2CH_2)_nOSO_3]M$$

wherein x is an integer in the range of about 10 to about 16, n is a number in the range of about 2 to about 30, and M is Na.

* * * * *